United States Patent [19]

Salisbury

[11] Patent Number: 5,023,597

[45] Date of Patent: Jun. 11, 1991

[54] DETECTION APPARATUS FOR SAFETY EYEWEAR

[76] Inventor: Richard Salisbury, 24331 Rhona Dr., Laguna Niguel, Calif. 92656

[21] Appl. No.: 486,537

[22] Filed: Feb. 28, 1990

[51] Int. Cl.[5] ..... G08B 13/14

[52] U.S. Cl. ..... 340/572; 250/221; 340/556; 340/573

[58] Field of Search ..... 340/572, 573, 576, 522, 340/556, 539, 542; 180/287, 272; 307/115-116; 361/175; 2/426; 250/221, 222.1

[56] References Cited

U.S. PATENT DOCUMENTS

| | | | |
|---|---|---|---|
| 4,507,653 | 3/1985 | Bayer | 340/539 |
| 4,603,327 | 7/1986 | Leonard et al. | 340/573 |
| 4,648,131 | 3/1987 | Kawaguchi et al. | 340/573 X |
| 4,665,385 | 5/1987 | Henderson | 340/539 |
| 4,684,933 | 8/1987 | Dill | 340/572 |
| 4,709,330 | 11/1987 | Yokoi et al. | 340/573 X |
| 4,814,632 | 3/1989 | Glaeser et al. | 340/573 X |

FOREIGN PATENT DOCUMENTS

| | | | |
|---|---|---|---|
| 3515445 | 10/1986 | Fed. Rep. of Germany | 340/568 |
| 2377674 | 9/1978 | France | 340/539 |

*Primary Examiner*—Glen R. Swann, III
*Assistant Examiner*—Thomas J. Mullen, Jr.
*Attorney, Agent, or Firm*—Blodgett & Blodgett

[57] ABSTRACT

A detection apparatus for monitoring specified safety eyewear being worn by persons who are either passing into or are located in the designated area which requires that a person in the area be wearing the specified safety eyewear. The detection apparatus includes an infrared reflector which is located on the specified eyewear, an infrared transmitter for transmitting a beam of infrared radiation towards the person, an infrared receiver which receives reflected radiation from the infrared reflector on the safety eyewear being worn by the person and an alarm which is normally inactive and which remains inactive as long as infrared radiation from the transmitter is reflected back to the infrared receiver from the reflector. The alarm is activated when infrared radiation is transmitted to the person and not reflected to the receiver due to the absence of specified safety eyewear which contains the appropriate infrared reflector.

14 Claims, 7 Drawing Sheets

Fig. 5
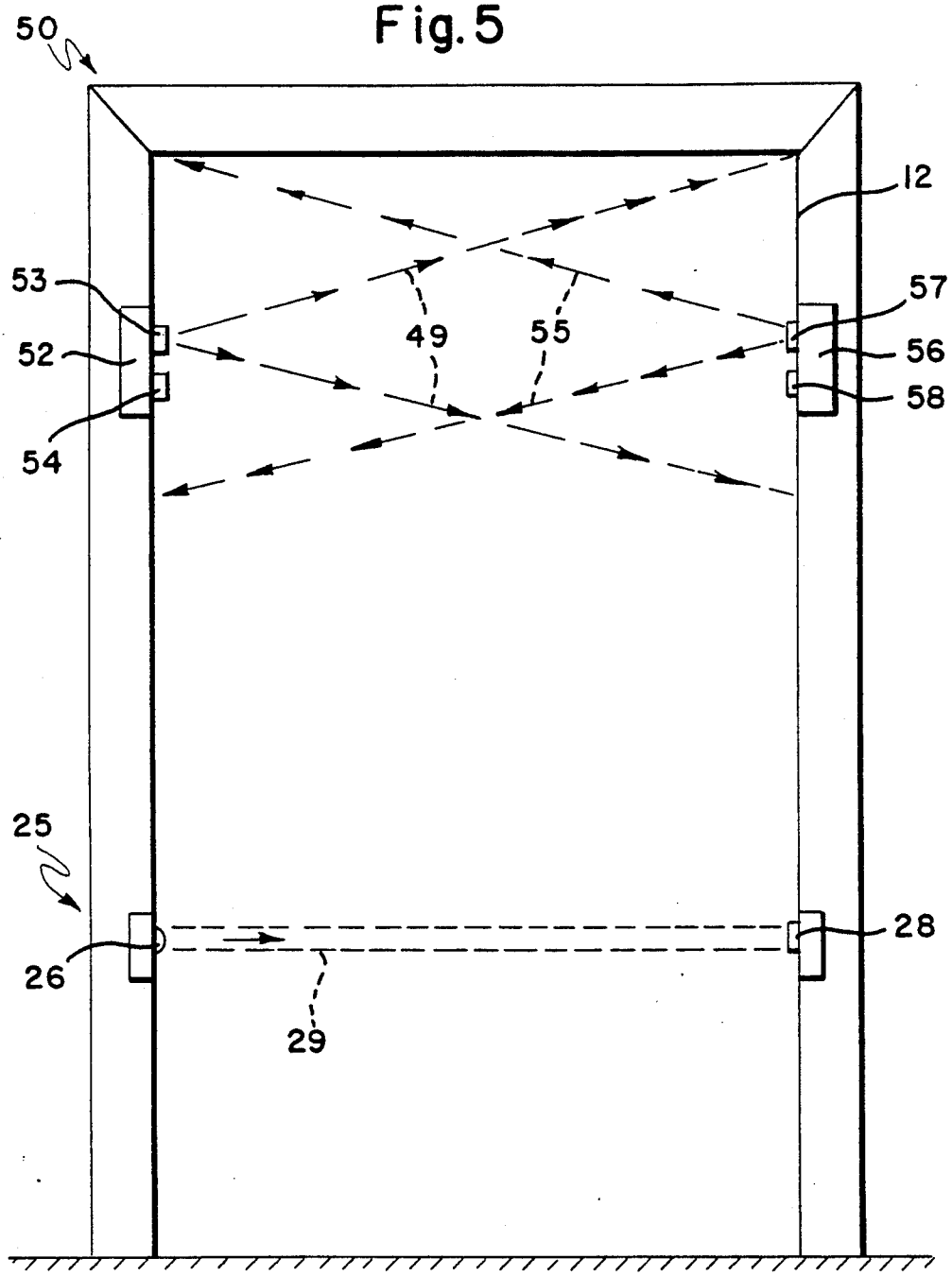
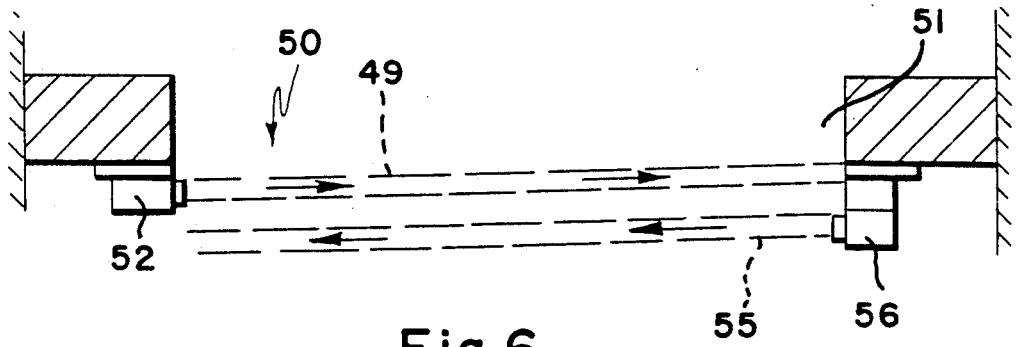
Fig. 6

DETECTION APPARATUS FOR SAFETY EYEWEAR

BACKGROUND OF THE INVENTION

The present invention relates generally to a detection system for monitoring specified safety eyewear being worn by individuals for whom the wearing of such eyewear is required in certain circumstances. The invention is specifically directed to the apparatus for detecting specified safety eyewear being worn by persons who are passing through an entryway into a designated area which requires that persons who are in the area are wearing the specified safety eyewear and for sounding an alarm when the specified eyewear is not detected on a person who is passing through the entryway into the designated area. The invention is also specifically directed to a detection system for preventing the starting of electrically driven machinery by a person who is not wearing the designated eyewear for that machine when attempting to start the machine.

Many types of detection systems have been developed for detecting persons who are approaching or passing through entryways to specified areas. More specifically, detection systems have been developed for discriminating between persons who are authorized to enter a specified area and those who are not. One such system discriminates between a person who is wearing a small metal object and a person who is not. This system can only be used in circumstances where the wearing or not wearing of a small metal object is tightly controlled such as in certain types of institutions. Another type of detection system provides a warning if the fastener of a garment which is worn by a person is not properly fastened in an environment where the fastener must be closed to ratify safety or sanitary requirements. None of the prior art detection systems are capable of detecting safety eyewear or distinguishing safety eyewear from conventional eyewear. Up to the present time, the monitoring of the wearing of specified safety eyewear by persons entering a designated area or for operating a designated machine is accomplished by visual manual inspection. A full time guard must be employed at the entryway to a designated and supervisor in a work area must maintain a constant visual to ensure that safety eyeglasses are worn by operators of certain types of machinery. In spite of extensive education and the proper use of safety eyewear and the threat of disciplinary action for violation of safety eyewear policies violations of eyewear safety policies continue to occur throughout industry. These violations inevitably lead to eye injuries. The slight inconvenience of wearing proper safety eyewear is a small price to pay to avoid the pain suffering and loss of production for an individual who had sustained an eye injury due to the failure to wear proper safety eyewear. Even if the individual is conscientious about using proper safety eyewear most of the time this is all negated when an injury occurs during one careless moment when a person forgets to have his or her safety eyewear when entering a designated area or is in a hurry or only intends to stay in the designated area for a short time.

These and other difficulties experienced with the use of safety eyewear in industry have been obviated by the present invention.

It is, therefore, a principal object of the invention to provide an automatic detection system for safety eyewear which will sound an alarm when a person who is not wearing the specified eyewear attempts to enter a designated area within which use of such eyewear is required.

Another object of this invention is the provision of an automatic detection system for safety eyewear which will detect the wearing of specified safety eyewear by persons of different heights who are entering a designated area within which use of such eyewear is required.

A further object of the present invention is the provision of an automatic detection system for specified safety eyewear which is being worn by a person who is operating an electrically driven machine for which the wearing of specified safety eyewear is required when operating the machine.

It is another object of the present invention to provide an automatic detection system for specified eyewear which is being worn by a person who is operating an electrically driven machine which prevents the machine from being started by a person who is not wearing the safety eyewear which is specified for that machine.

A still further object of the invention is the provision of an automatic detection system for specified safety eyewear which is being worn by a person who is operating an electrically driven machine which cannot be started by a person who is not wearing the specified eyewear and which will automatically shut off when that person leaves the machine.

With these and other objects in view, as will be apparent to those skilled in the art, the invention resides in the combination of parts set forth in the specification and covered by the claims appended hereto.

SUMMARY OF THE INVENTION

In general, the invention consists of detection apparatus for monitoring specified safety eyewear being worn by a person who is entering a designated area which requires the wearing of such eyewear. The detection apparatus comprises an infrared reflector which is fixed to the designated eyewear, an infrared transmitter and an infrared receiver which are located at one side of an entryway to the designated area and an alarm system which is activated when a person not wearing the specified eyewear attempts to pass through the entryway into the designated area. When a person who is wearing the specified safety eyewear enters the entryway, infrared radiation from the transmitter will be reflected back to the receiver from the infrared reflector of the specified eyewear so that the alarm which is controlled by the receiver will not be activated. The invention also consists of a detection apparatus for monitoring specified safety eyewear being worn by a person who is located at a designated position for operating an electrically driven machine which requires the wearing of the specified eyewear during the operating of a machine. The detection apparatus comprises an infrared reflector on the specified eyewear, an infrared transmitter which directs infrared radiation toward the position which is being occupied by the machine operator, an infrared receiver which is located adjacent the infrared transmitter and control circuitry for the machine which is operatively connected to the transmitter and receiver so that the machine can only be operated by a person who is wearing the specified safety eyewear.

BRIEF DESCRIPTION OF THE DRAWINGS

The character of the invention, however, may be best understood by reference to one of its structural forms, as illustrated by the accompanying drawings in which:

FIG. 5 is a front elevational view which is similar to FIG. 1 showing a second embodiment of the invention which was two transmitter receiver combinations, FIG. 6 is a plan view of the second embodiment, in which two transmitters receiver combinations are employed.

DETAILED DESCRIPTION OF THE INVENTION

Figure 1:
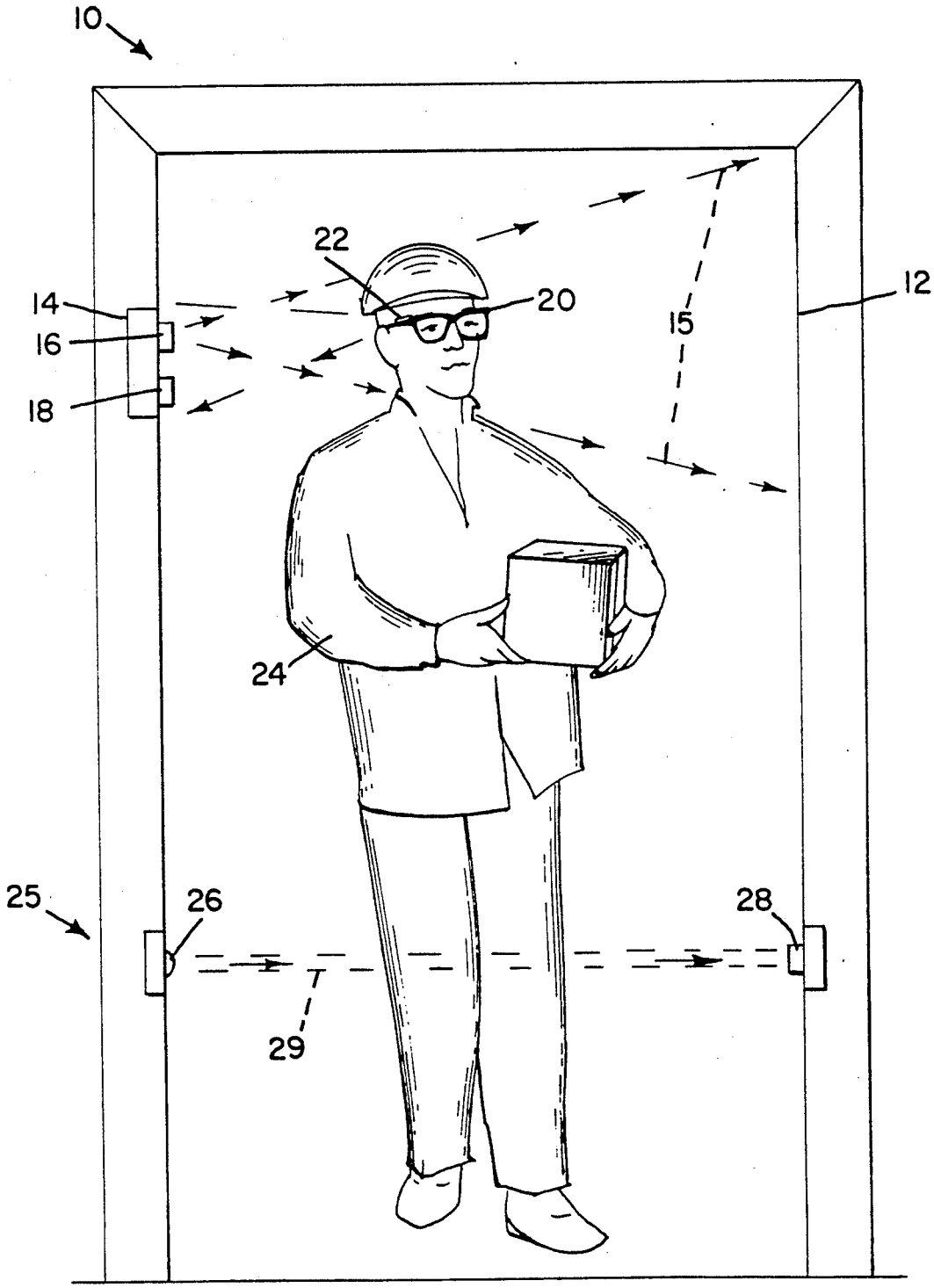
FIG. 1 is a front elevational view showing a person in an entryway which is equipped with the safety eyewear detection apparatus of a first embodiment the present invention.
Figure 2:
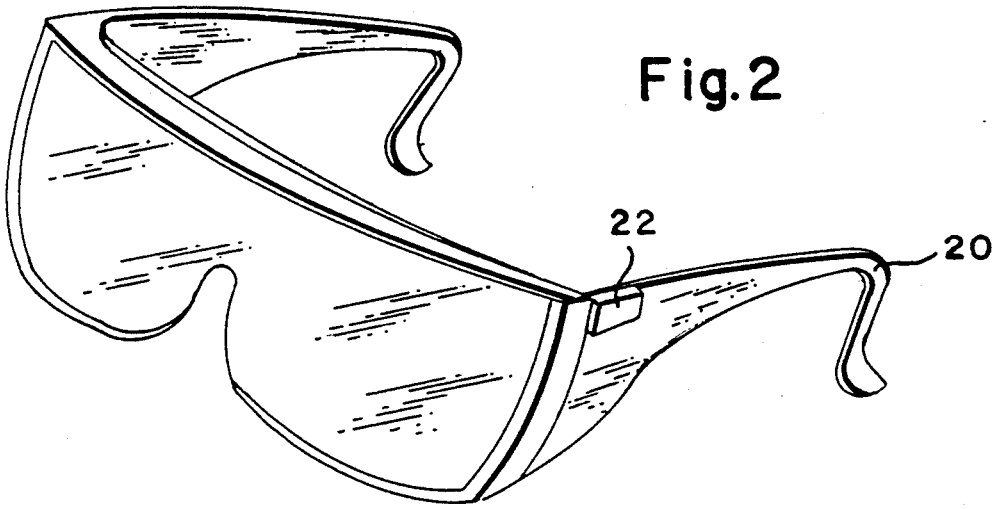
FIG. 2 is a perspective view of an example of safety eyewear which is equipped with an infrared reflector which forms part of the detection apparatus of the present invention.

Referring first to FIG.'s 1–3 there is shown a first embodiment cf a detection apparatus of the present invention which is generally indicated by the reference numeral 10. The detection apparatus 10 is shown applied to an entryway 12 and comprises a transceiver 14 which is mounted on one side of the entryway 12. The transceiver 14 includes an infrared transmitter 16 which transmits a spreading beam 15 of infrared radiation to the opposite side of the entryway and an infrared receiver 18. The detection apparatus 12 also includes an electronic sensor, generally indicated by the reference numeral 25, for sensing the presence of a person in the entryway 12. The sensor 25 comprises a lamp 26 at one side of the entryway 12 and a photo receptor 28 at the opposite side of the entryway 12 for receiving a beam of light from the lamp 26. The photo receptor 28 is actuated when the beam of light, indicated by the reference numeral, 29 from the lamp 26 is interrupted when a person, indicated by the reference numeral 24, passes through the entryway 12. The detection apparatus 10 also includes an infrared reflector 22 which is mounted on the frame of protective eyewear 20 which is shown being worn by a person such as that which is worn by the individual 24 who is depicted in FIG. 1. The reflector 22 contains a material which reflects infrarred radiation. Excellent results have been obtained from a 3M material which is sold under the trademark reflexite and designated by the model numbers Ad1000P and AC/1000M.

Only the proper safety eyewear which is specified for a designated area will contain the infrared reflector 22. When a person enters this designated area through the entryway 12, infrared radiation from the transmitter 16 will strike the infrared reflector 22 and will be reflected back to the infrared receptor 18. If the sensing means 25 senses a person in the entryway 12 and that person does not have proper safety eyewear which contains the infrared reflector 22, infrared radiation from the transmitter 16 will not be reflected back to the receiver 18. This will cause the receptor 18 to initiate the sounding of an alarm, not shown, which signals the arrival of a person into the designated area who is not wearing the specified safety eyewear for that area.

Figure 3:
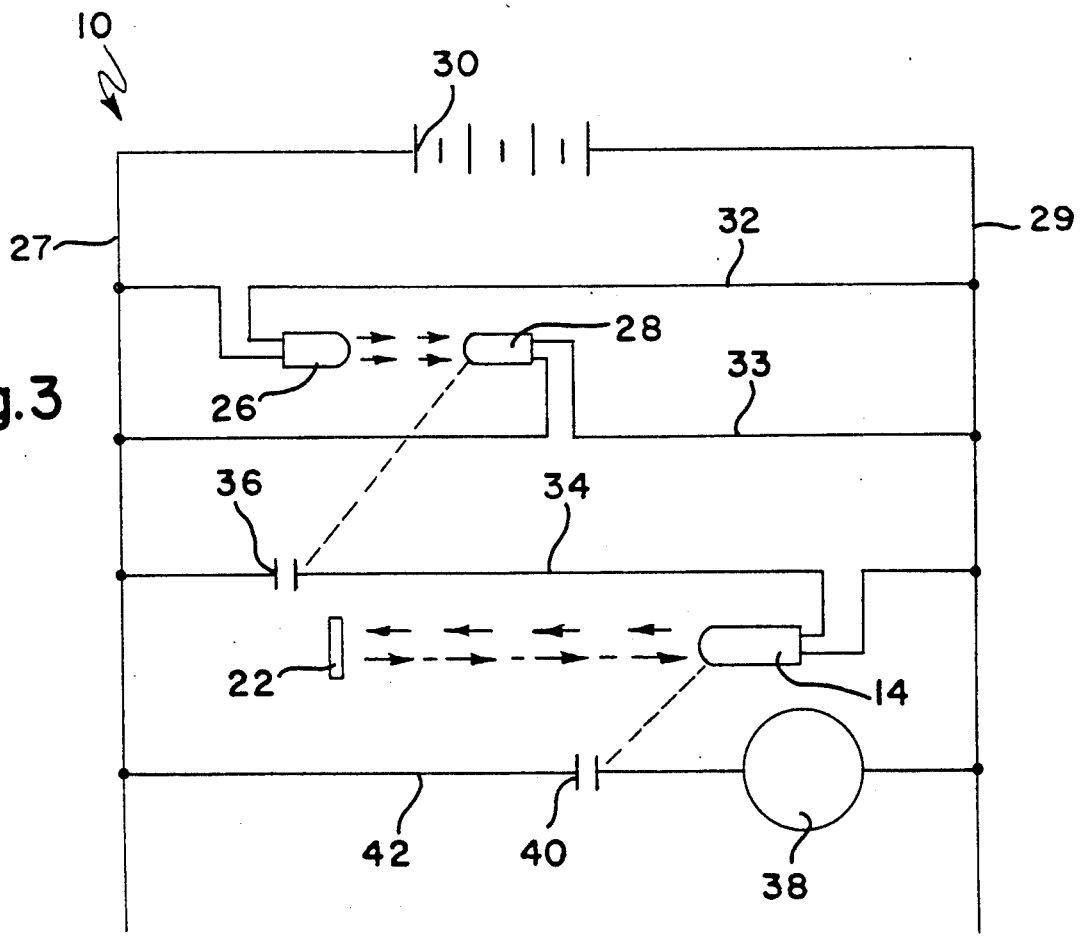
FIG. 3 is an electrical diagram of the electrical controls for the detection apparatus of the first embodiment of the present invention.

Referring particularly to the electrical diagram of FIG. 3, the interaction of the various elements which make up the detection apparatus 10 is described in conjunction with FIG. 3. The lamp 26 and the photo receptor 28 are located on lines 32 and 33 which are connected across a pair of power lines 27 and 29 from a source of electrical power 30. The transceiver 14 is located on a line 34 which contains a normally open contact 36 to maintain the transceiver 14 in a normally de-energized state. When a person enters the entryway 12, the beam of light from the lamp 26 is interrupted. This causes the normally open contact 36 of the receptor 28 to close, thereby completing a circuit across the power lines 27 and 29 through line 34 and energizing the transceiver 14. The transmitter portion 16 of the transceiver transmits a beam of infrared radiation toward the other side of the entryway 12. If the person in the entryway 12 is wearing the specified safety eyewear, a portion of the infrared beam will strike the reflector 22 and be reflected back to the receiver portion 18 of the transceiver. If the person is not wearing the specified safety eyewear, no infrared radiation will be reflected to the receiver 18. This causes its normally open contact 40 on line 42 to close, thereby connecting line 42 across the power line 27 and 29 and energizing an alarm 38 which is on line 42. This will either remind the individual who set off the alarm of the need to wear proper eyewear or alert supervisory personnel that a person who is wearing improper eyewear has entered the designated area.

Figure 4:
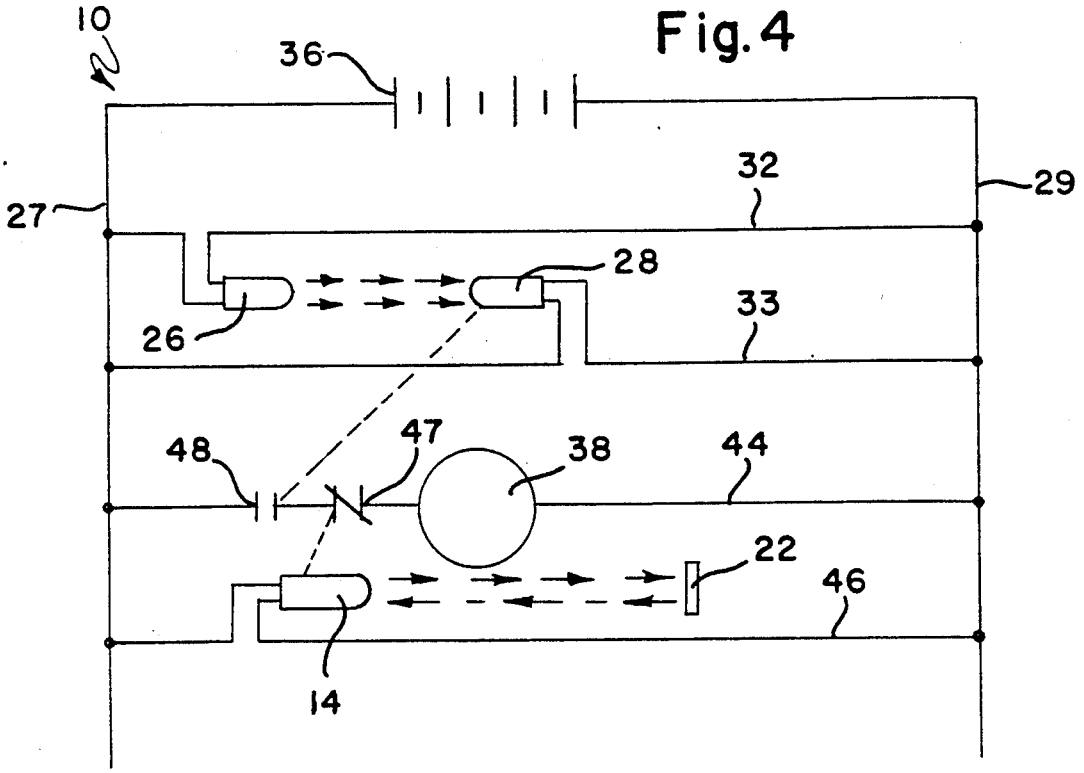
FIG. 4 is an electrical diagram showing a variation of electrical controls for the first embodiment of the present invention shown in FIG. 1.

Referring to FIG. 4, there is shown electrical diagram which illustrates a variation in the electrical controls and operation of the first embodiment of the present invention and is generally indicated by the reference numeral 10, The lamp 26 and the photo receptor 28 are connected to lines 32 and 33 which are connected across the power lines 27 and 29 in the same manner as shown in FIG. 3. The transceiver 14 is located on a line 46 which is connected across the power lines 27 and 29 so that the transceiver 14 is normally in an energized state. Therefore, the beam of infrared radiation from the transmitter portion 16 of the transceiver is transmitted continuously across the entryway 12. The alarm 38 is located on a line 44 which contains a normally open contact 48 and a normally closed contact 47. The alarm 38 is, thereby, normally in a de-energized state. The contact 48 is part of the internal circuitry of receptor 28. When the beam of light from the lamp 26 is interrupted by a person walking through the doorway 12, the photo receptor 28 closes the contact 48. If the person who interrupted the beam of light from the lamp 26 is wearing specified safety eyewear, infrared radiation from the transmitter portion of the transceiver 14 will strike the reflector 22 on the eyewear and will be reflected back to the receiver portion 18 of the transceiver. The transceiver 14 has a built in relay circuit which includes the normally closed contact 47 and is effective to open the contact 47 when reflected infrared radiation is received by the receiver 18. This will keep the line 44 open and maintain the alarm 38 in the de-energized state. However, if the person is not wearing the proper protective eyewear, no reflected infrared radiation will be received by the transceiver 14 and the normally closed contact 47 will remain closed. Since the normally, open contact 48 is also closed by the relay circuit of the photo receptor 28 the alarm 38 will be energized to warn the person who is passing through the entryway 12 and other supervisory personnel that a person is entering the designated area without wearing the specified safety eyewear or that area.

Figure 8:
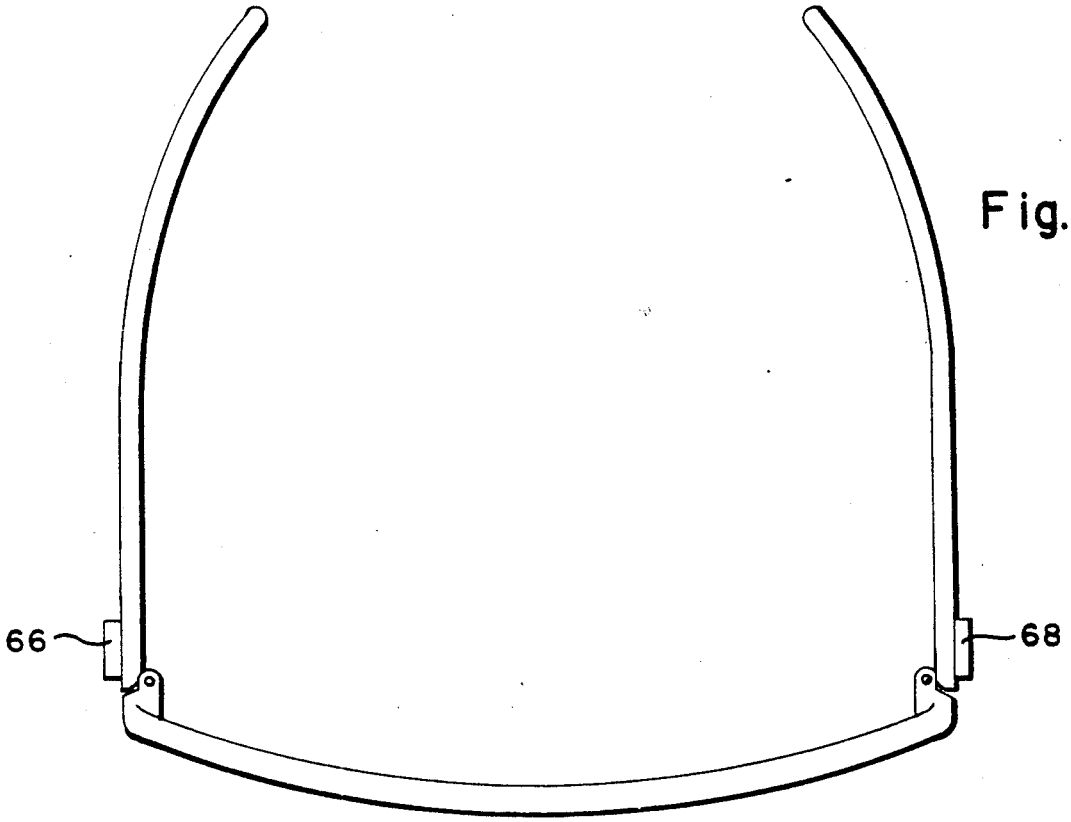
FIG. 8 is a plan view of safety eyewear which is equipped with two infrared reflectors which form part of the second embodiment of FIGS. 5–7.

Referring to FIG.,s 5, 6 and 7, there is shown a second embodiment of the invention which is generally indicated by the reference numeral 50. The detection apparatus 50 comprises the same electronic sensor 25 as for the first embodiment including the lamp 26 for transmitting the beam of light 29 across the entryway 12 to the photo receptor 28. The detection apparatus 50 also comprises a first transceiver 52 which is located at one side of the entryway 12 and a second transceiver 56 which is located at the opposite side of the entryway. The first transceiver 52 comprises a transmitter 53 for transmitting a beam, 49, of infrared radiation to the opposite side of the entryway and a receiver 54 for receiving reflected infrared radiation. The second transceiver 56 comprises a transmitter 57 for transmitting a beam, 55, of infrared radiation t the first side of the entryway and a receiver 57 for receiving reflected infrared radiation. Each infrared transmitter transmits a beam of infrared radiation which spreads vertically but is relatively narrow from front to back. The transceivers 52 and 56 are offset front to back as shown in FIG. 6 so that the beams from their respective transceivers are offset front to back. Therefore, the infrared radiation from one transmitter will not affect the receiver of the other transmitter. The safety eyewear which is to be used with the second embodiment 50, indicated by the reference numeral 64 in FIG. 8, is equipped two infrared reflectors 66 and 68 which are located on opposite sides of the eyeglass flame.

Figure 7:
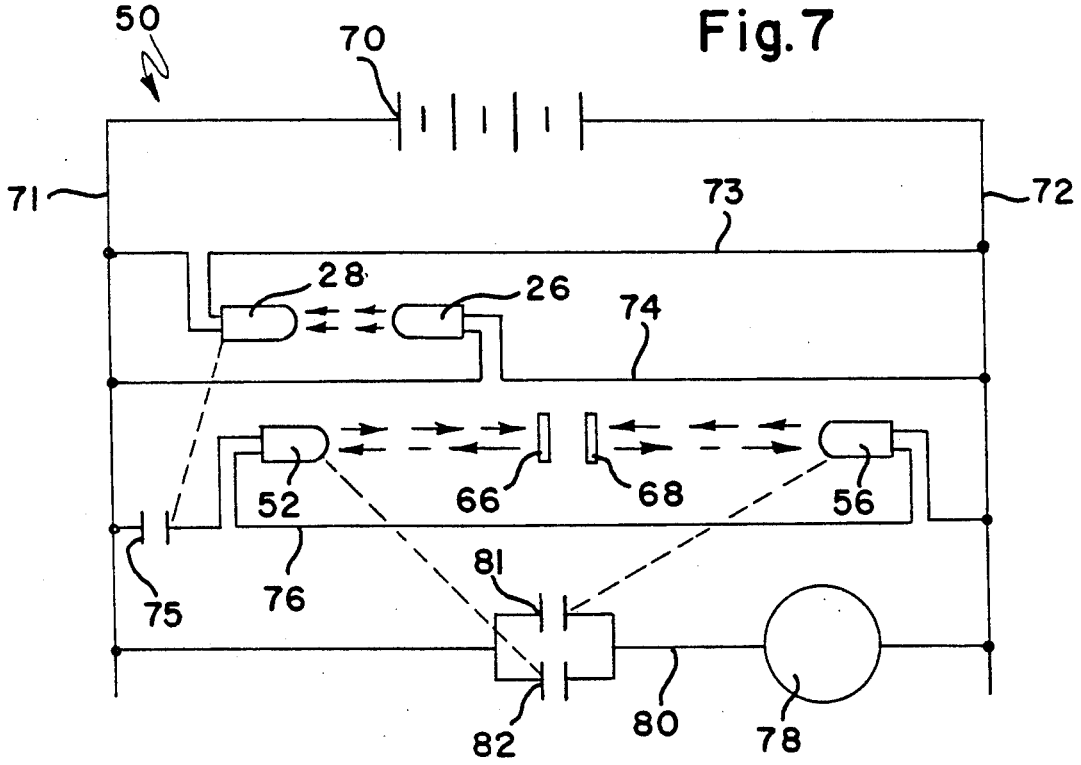
FIG. 7 is an electrical diagram of the electrical controls for the second embodiment of FIG. 5.

The operation of the second embodiment 50 will now be readily understood with reference to the electrical controls which are shown in FIG. 7. The lamp 26 and the photo receptor 28 are located on lines 74 and 73, respectively, which are connected across a pair of power lines 71 and 72 which are, in turn, connected to a source of electrical power 70. The lamp 26 is on constantly for transmitting a continuous beam of light 29 to the photo receptor 28. The first and second transceivers 52 and 56, respectively, are located on a line 76 which also contains a normally open contact 75. This maintains the line 76 open and the first and second transceivers 52 and 56, respectively, deactivated. An alarm 78 is located on a line 80 which contains a pair of parallel normally open contacts 81 and 82. The contacts 81 and 82 keep the line 80 open and maintain the alarm 78 in a deactivated state. The closing of ether of the contacts 81 and 82 will complete a circuit across the line 80 between the power line 71 and 72 to activate the alarm 78. The contact 81 is part of a relay circuit of the second transceiver 56. The normally open contact 81 forms part of a relay circuit of the first transceiver 52. When a beam of light from the lamp 26 is interrupted by a person walking through the entryway 12, the photo receptor 28 is effective to close the normally open contact 75 which forms part of the relay circuit of the photo receptor 28. The closing of contact 75 completes a circuit across the line 76 and energizes the transceivers 52 and 56 for transmitting beams of infrared radiation in opposite directions, as shown in FIG.'s 5 and 6. If the person who is passing through the entryway 12 is wearing proper safety eyewear 64, infrared radiation will be reflected from the reflector 66 back to the receptor portion 54 of the first transceiver 52 and infrared radiation will be reflected from the reflector 68 back to the receiver portion 58 of the second transceiver 56. When this occurs, the contacts 81 and 82 will remain open. However, if the receiver portion of either of the transceivers 52 and 56 does not receive reflected infrared radiation it will close its respective contact 81 or 82. This will complete a circuit across line 80 and energize the alarm 78.

Figure 9:
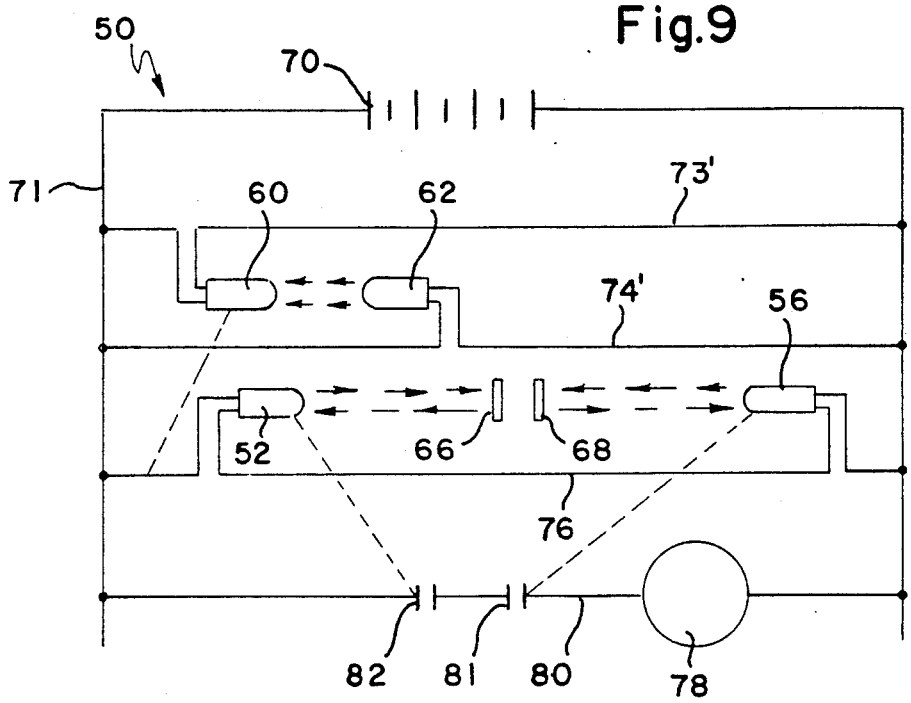
FIG. 9 is an electrical diagram showing a variation of the electrical controls for the second embodiment.

FIG. 9 shows a variation in the controls and operation of the second embodiment of the invention which is generally indicated by the reference numeral 50'. The controls for the variation 50' of the second embodiment are identical to the controls which are shown and described in FIG. 7, except that the normally open contacts 82 and 81 of the first and second transceivers 52 and 56 respectively are arranged in series on line 80 which contains the alarm 78. In this variation, if only one transceiver fails to receive reflected infrared radiation, its corresponding contact 81 or 82 on line 80 will be closed. However, the other contact on line 80 which is controlled by the other transceiver will remain open as long as the other transceiver receives reflected infrared radiation from the corresponding reflector of the safety eyewear 64. If neither of the transceivers 52 and 56 receives reflected infrared radiation, both contacts 81 and 82 will be closed and the alarm 78 will be activated.

Figure 10:
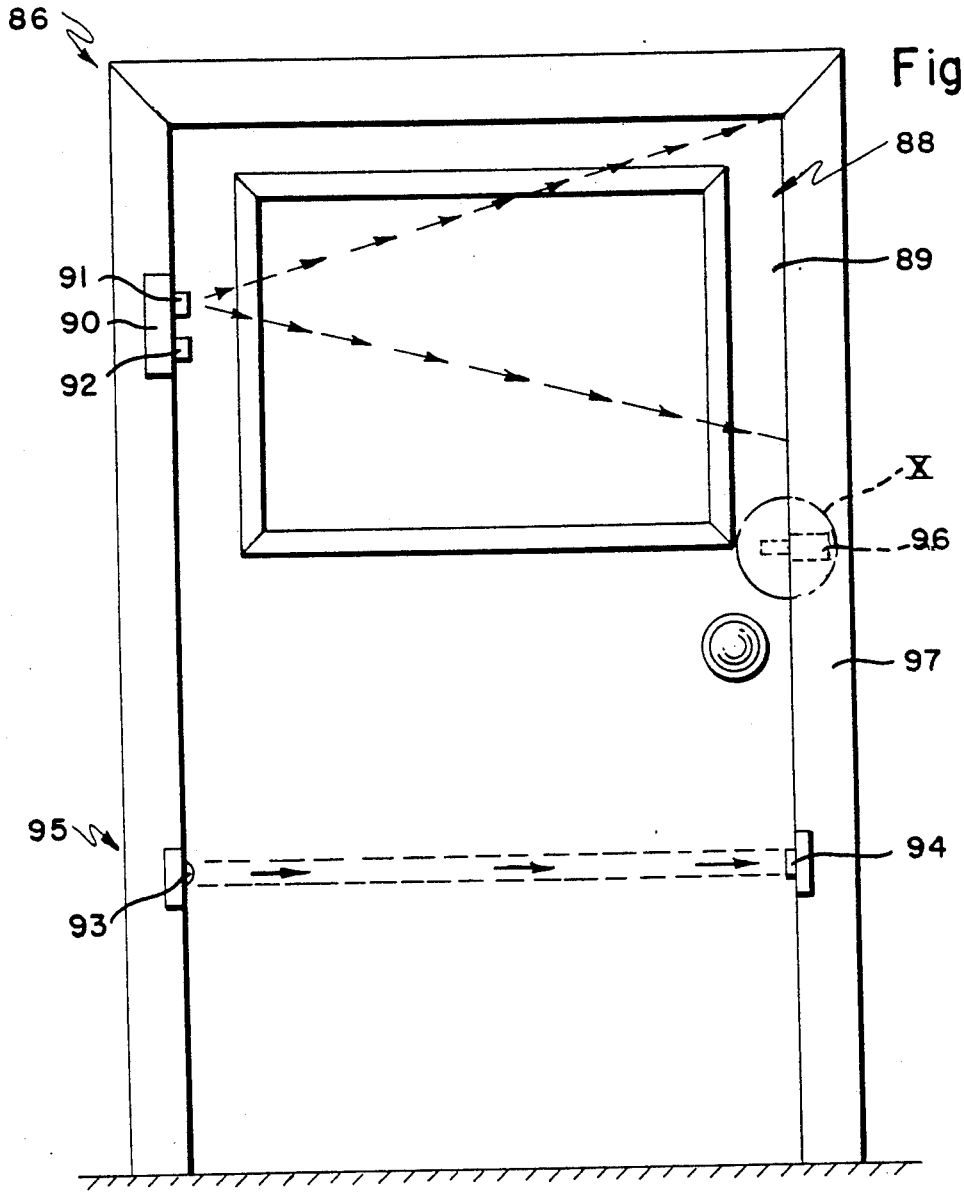
FIG. 10 is a front elevational view of an entryway which is equipped with a third embodiment of the invention.
Figure 11:
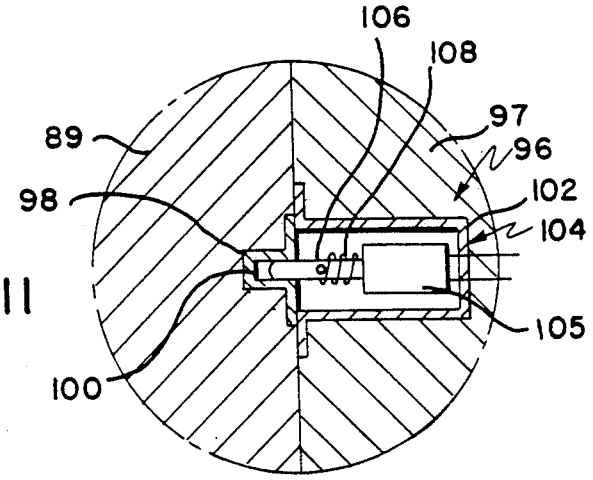
FIG. 11 is a fragmentary cross sectional view of an area of FIG. 10 which is indicated by the reference numeral X and shown on an enlarged scale.

Referring to FIGS. 10 and 11 there is shown a third embodiment of the detection apparatus of the present invention which is generally indicated by the reference numeral 86. The detection apparatus 86 is shown applied to an entryway 88 which is closed by a door 89. The door 89 is maintained in a normally locked state by means of an electrically actuated locking mechanism 96. The detection apparatus 86 comprises a transceiver 90 which is located at one side of the doorway and which includes an infrared transmitter 91 and an infrared receiver 92. When activated, the transmitter 91 projects a beam of infrared radiation across the entryway 88 to the opposite side of the entryway. The detection apparatus 86 also comprises an electric sensor, generally indicated by the reference numeral 95, which includes a lamp 93 at one side of the entryway 88 and a photoreceptor 94 at the opposite side of the entryway. The lamp 93 projects a light beam across the entryway to the photoreceptor 94. The transceiver 90 and the sensor 95 are located sufficiently in front of the door 89 so that the light beam from the lamp 93 and the infrared radiation from the transmitter 91 will be interrupted by a person, as that person approaches the door 89. The door 89 is maintained in a normally locked state to prevent persons from entering the designated area beyond the door, unless the person is wearing specified safety eyewear. The locking mechanism 96 locks the door 89 against the adjacent door jam 97 and comprises a catch 98 which is recessed in the outer edge of the door and which has a bore 100 which faces the door jam 97. The lock 96 also includes a housing 102 which is recessed in the edge of the door jam and which faces the catch 98. The housing 102 contains a solenoid, generally indicated by the reference numeral 104, which includes a core 105 and a plunger 106 which is moveable relative to the core 105 toward and away from the bore 100 of the catch 98. When the solenoid 104 is in the de-energized state, a spring 108 maintains the plunger 106 within the bore 100 to maintain the door 89 in the locked condition. When the solenoid 104 is energized, the plunger 106 is drawn into the core out of the bore 100 so that the door 89 is in the unlocked condition.

Figure 12:
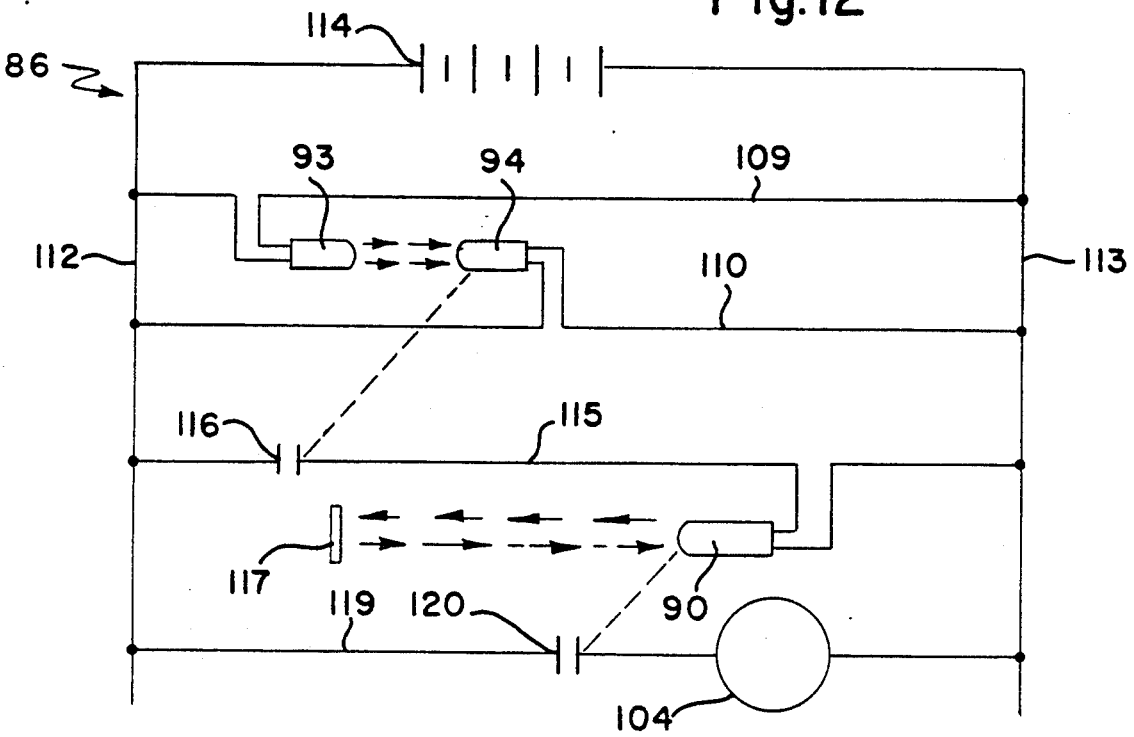
FIG. 12 is an electrical diagram of the electrical controls for the third embodiment of the invention.

The operation of the third embodiment 86 will be readily understood in conjunction with the electrical controls for the third embodiment shown in FIG. 12.

Referring to FIG. 12, the lamp 93 and the photo receptor 94 are located on lines 109 and 110 which extend across a pair of power lines 112 and 113 which are connected to a source of electrical power 114. The photo receptor 94 includes a relay circuit which includes a normally open contact 116 on line 115. The transceiver 90 is also located on line 115 and is maintained in a de-energized state due to the open contact 116. The transceiver 90 has a relay circuit which includes a normally open contact 120 on line 119. The solenoid 104 is also located on line 119 and is maintained in the deactivated state due to the open contact 120. When a person approaches the door 89 the light beam from the lamp 93 to the photo receptor 94 is interrupted. This causes the relay circuit of the photo receptor 94 to close the normally open contact 116. This completes a circuit across the line 115 and energizes the transceiver 90. The transmitter 91 of the transceiver 90 projects a beam of infrared radiation across the doorway 88. If the person who is approaching the door 89 is wearing specified safety eyewear, it has attached thereto an infrared reflector 117. The infrared radiation from the transmitter 91 strikes the infrared reflector and a portion of the beam is reflected back to the receiver 92. When the reflected infrared radiation is received by the receiver 92, its relay circuit is activated to close the normally open contact 120 to complete a circuit across the line 119 and thereby energize the solenoid 104. When the solenoid 104 is energized, the plunger 106 is drawn out of the bore 100, thereby unlocking the door 89. This allows the person to open the door and pass through the entryway 88 into the designated area behind the door 89.

Figure 13:
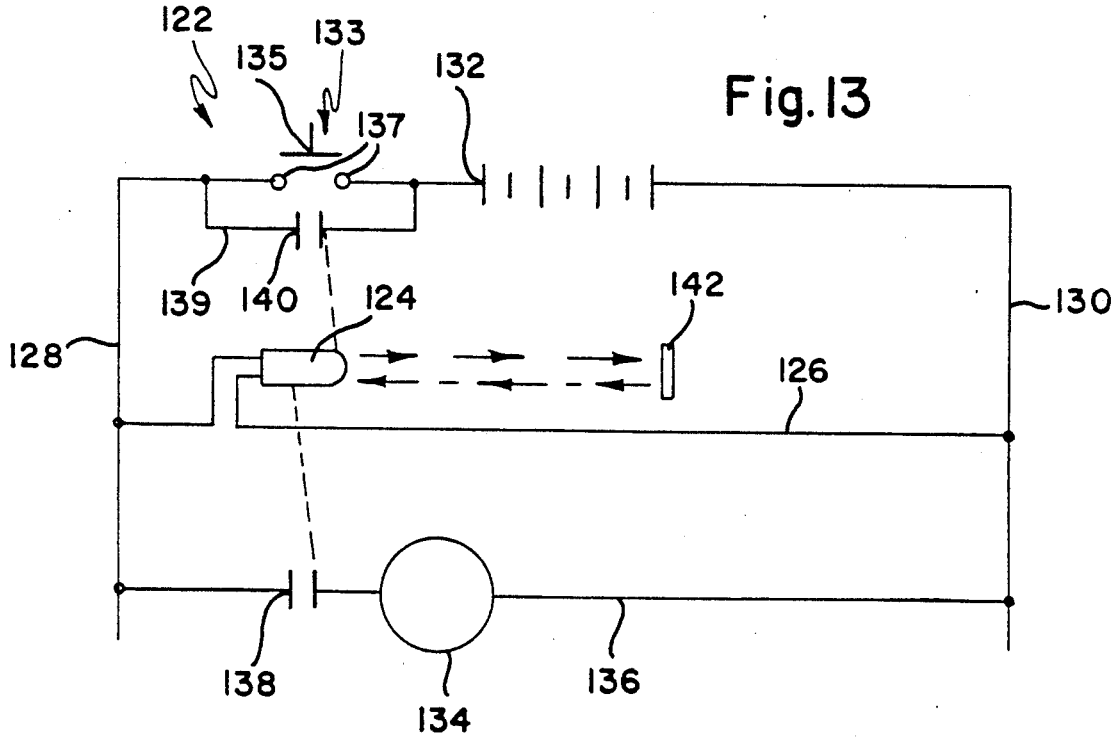
FIG. 13 is an electrical diagram of the electrical controls for a fourth embodiment of the invention.

Referring to FIG. 13 there is shown a fourth embodiment of the detection apparatus of the present invention which is generally indicated by the reference numeral 122. The detection apparatus 122 comprises a transceiver 124 which is identical to any of the transceivers in the previous embodiments and includes an infrared transmitter and an infrared receiver. The transceiver 124 is located on a line 126 which is connected across a pair of power lines 28 and 130 which are connected to a source of electrical power 132 through an electrical starting circuit, generally indicated by the reference numeral 133. The starting circuit 133 includes a spring return normally open push button switch 135 which, when depressed, bridges a pair of contacts 137 to connect the power line 128 to the source of electrical power 132. A line 139 bridges the contacts 137 and contains a normally open contact 140 which keeps the line 139 open. The contact 140 is part of a relay circuit of the transceiver 124 which also includes a normally open contact 138 on line 136. A drive motor 134 for the machine is also located on line 136 and is maintained in a normally de-energized state by means of the open contact 138. The transceiver 124 is positioned in relation to the machine so that it is located on one side of a position which is occupied by the operator of the machine when he or she is operating the machine. Therefore, the transmitter portion of the transceiver projects a beam of infrared radiation towards to the opposite side of the location which is normally occupied by the operator. The machine is started by pressing the push button 134 to bridge the contacts 137 and to complete a circuit across the line 126, thereby energizing the transceiver 124. Energization of the transceiver 124 will cause its transmitter to project a beam of infrared radiation toward the operator of the machine. If the operator is wearing safety eyewear which is specified for that machine, it will have an infrared reflector 142 which reflects the infrared radiation back to the receiver portion of the transceiver 124. This causes the normally open contacts 140 and 138 to close. Closing of the contact 138 completes a circuit across the line 136 to energize the drive motor 134 of the machine. Closing of the contact 140 closes the line 139 to effectively bridge the contacts 137 so that everything beyond the starting circuit 133 is maintained energized when the push button 135 is released. If the operator of the machine is not wearing safety eyewear which is specified for that machine, no reflected infrared radiation will be received by the transceiver 124. Therefore, the contacts 138 and 140 remain open and the machine can not be started. If the operator removes the safety eyewear or walks away from the machine, reflected infrared radiation will not be received by the transceiver 124, thereby causing contacts 138 and 140 to open and causing the machine to stop. Since the contact 140 also opens, the circuit through the line 128 will be broken and the transceiver will be de-energized. The machine can only be restarted by the pushing of the start button 135 by a person who is wearing safety eyewear which is specified for the machine.

Clearly, minor changes may be made in the form and construction of the invention without departing from the material spirit thereof. It is not, however, desired to confine the invention to the exact form herein shown and described, but it is desired to include all subject matter that properly comes within the scope claimed.

The invention having been thus described, what is claimed as new and desired to secure by Letters Patent is:

1. A detection apparatus for monitoring specified safety eyewear being worn by persons who are passing through an entryway into a designated area which requires that persons in said area be wearing said specified safety eyewear, said detection apparatus comprising:

(a) an infrared reflector which reflects infrared radiation and which is fixed to said specified eyewear, (b) an infrared transmitter which is located at one side of said entryway for transmitting a beam of infrared radiation toward the opposite side of said entryway so that at least a portion of said beam is reflected back to said one side by the reflector of said specified eyewear which is worn by a person who is passing through said entryway, (c) a receiver which is located at said one side of said entryway for receiving said reflected infrared radiation, and (d) an alarm which is normally inactive and which is operatively connected to said transmitter and said receiver, said alarm remaining inactive when a beam of infrared radiation is transmitted by said transmitter and reflected to said receiver, said alarm being activated when a beam of infrared radiation is transmitted by said transmitter and no reflected infrared radiation is received by said receiver.

2. A detection apparatus as recited in claim 1, wherein said transmitter and said receiver are housed in a single transceiver unit.

3. A detection apparatus as recited in claim 1, wherein said transmitter is normally inactive and activated to transmit a beam of infrared radiation upon receiving a predetermined electrical signal and wherein said detection apparatus comprises an electronic sensor which is operatively connected to said transmitter and which is located at said entryway for sensing a person who is passing through said entryway and for transmitting said predetermined electrical signal to said transmitter when a person passes through said entryway.

4. A detection apparatus as recited in claim 3, wherein said electronic sensor comprises:

(a) a lamp which is located at one side of said entryway for projecting a beam of light toward the opposite side of said entryway, and (b) a photo receptor which is located on the side of said entryway opposite from said lamp for receiving said beam of light, said receptor being operatively connected to said transmitter for transmitting said predetermined electrical signal to said transmitter upon the interruption of said beam of light by a person who is passing through said entryway.

5. A detection apparatus as recited in claim 1, wherein said transmitter is a first transmitter and said receiver is a first receiver, wherein a second infrared transmitter is located at the opposite side of said entryway for transmitting infrared radiation toward said first side and a second infrared receiver is located at said opposite side for receiving reflected infrared radiation from said first side, wherein there are two infrared reflectors, a first infrared reflector which is fixed to one side of said designated eyewear for reflecting infrared radiation from said first transmitter to said first receiver and a second reflector for reflecting infrared radiation from said second transmitter to said second receiver and, wherein said alarm is operatively connected to said first and second transmitters and said first and second receivers, said alarm remaining inactive when infrared radiation is transmitted by said first and second transmitters and reflected from said first and second reflectors, respectively, to said first and second receivers, respectively, said alarm being activated when infrared radiation is transmitted by said first and second transmitters and no reflected infrared radiation is received by at least one of said receivers.

6. A detection apparatus as recited in claim 1, wherein said transmitter is a first transmitter and said receiver is a first receiver, wherein a second infrared transmitter is located at the opposite side of said entryway for transmitting infrared radiation toward said first side and a second infrared receiver is located at said opposite side for receiving reflected infrared radiation from said first side, wherein there are two infrared reflectors, a first infrared reflector which is fixed to one side of said designated eyewear for reflecting infrared radiation from said first transmitter to said first receiver and a second reflector for reflecting infrared radiation from said second transmitter to said second receiver and, wherein said alarm is operatively connected to said first and second transmitters and said first and second receivers, said alarm remaining inactive when infrared radiation is transmitted by said first and second transmitters and reflected from at least one of said first and second reflectors, respectively, to at least one of said first and second receivers, respectively, said alarm being activated when infrared radiation is transmitted by said first and second transmitters and no reflected infrared radiation is received by either of said receivers.

7. A detection apparatus for monitoring specified safety eyewear being worn by persons who are approaching an entryway to a designated area which is closed by a door which has an electrically controlled lock, said lock being normally locked and being unlocked upon receiving a predetermined electrical signal, said detection apparatus comprising:

(a) a infrared reflector which reflects infrared radiation and which is fixed to said specified eyewear, (b) a transmitter which is located at one side of said entryway in front of said door for transmitting a beam of infrared radiation toward the opposite side of said entryway so that at least a portion of said beam is reflected back toward said one side by the reflector of said specified eyewear which is worn by a person who is approaching said door, and (c) a receiver which is operatively connected to said electrically controlled lock and which is located at said one side of said entryway in front of said door for receiving said reflected infrared radiation and for transmitting said predetermined electrical signal to said lock for unlocking said lock when infrared radiation is transmitted by said transmitter and reflected infrared radiation is received by said receiver.

8. A detection apparatus as recited in claim 7, wherein said transmitter and said receiver are housed in a single transceiver unit.

9. A detection apparatus as recited in claim 8, further comprising an electronic sensor which is operatively connected to said transmitter and which is located in front of said door for sensing a person who is approaching said door, said transmitter being normally inactive and activated to transmit a beam of infrared radiation when said electronic sensor senses a person who is approaching said door.

10. A detection apparatus as recited in claim 9, wherein said electronic sensor comprises:

(a) a lamp which is located at one side of said entryway for projecting a beam of light toward the opposite side of said entryway, and (b) a photo receptor which is located on the side of said entryway opposite from said lamp for receiving said beam of light, said photo receptor being operatively connected to said transmitter for activating said transmitter when said beam of light is interrupted by a person who is approaching said door.

11. A detection apparatus for monitoring specified safety eyewear being worn by persons who are passing through an entryway into a designated area which requires that such persons in said area be wearing said specified safety eyewear, said detection apparatus comprising:

(a) a reflector which reflects infrared radiation only and which is fixed to said specified eyewear, (b) a transmitter which is located at one side of said entryway for transmitting a beam of infrared radiation toward the opposite side of said entryway so that at least a portion of said beam is reflected back to said one side by the reflector of said specified eyewear which is worn by a person who is passing through said entryway, (c) a receiver which is located at said one side of said entryway for receiving said reflected infrared radiation, (d) an electronic sensor which is located at said entryway for sensing a person who is passing through said entryway, and (e) an alarm which is operatively connected to said receiver and said electronic sensor which is normally inactive and activated only when said electronic sensor senses a person passing through said entryway and no reflected infrared radiation is received by said receiver.

12. A detection apparatus for monitoring specified safety eyewear being worn by a person who is located at a designated position for operating an electrically driven machine which requires the wearing of said specified eyewear by a person who is operating said machine, said detection apparatus comprising:

(a) an infrared reflector which reflects infrared radiation and which is fixed to said specified eyewear, (b) an infrared transmitter which is located at one side of said designated position for transmitting a beam of infrared radiation across said designated position to a side of said designated position which is opposite said one side so that at least a portion of said beam is reflected back to said one side by the infrared reflector of said specified eyewear by a person who is located at said designated position, (c) a receiver which is located at said one side of said designated position for receiving said reflected infrared radiation, and (d) control circuitry for said machine which is operatively connected to said transmitter and said receiver said control circuitry being effective to maintain said machine normally inoperative and to enable said machine to operate only when radiation is transmitted by said transmitter and reflected from said reflector to said receiver.

13. A detection apparatus as recited in claim 12, wherein said machine has a normally open starting switch is operatively connected to said control circuitry and wherein said transmitter is normally de-energized and is energized when said starting switch is closed, said transmitter being maintained energized and said machine being maintained operative as long as reflective infrared radiation from said reflector is received by said receiver, said transmitter being de-energized and said machine being rendered inoperative when no reflective infrared radiation is received by said receiver.

14. A detection apparatus as recited in claim 12, wherein said transmitter and said receiver are housed in a single transceiver unit.

* * * * *